US007772971B1

(12) United States Patent
Hillenburg et al.

(10) Patent No.: US 7,772,971 B1
(45) Date of Patent: Aug. 10, 2010

(54) METHOD FOR THE PROACTIVE VERIFICATION OF ALARM SIGNALS FROM THE PROTECTED PREMISE LOCATION

(75) Inventors: Mark A. Hillenburg, Springfield, MO (US); Rick A. Britton, 4009 W. 150th St., Leawood, KS (US) 66224

(73) Assignee: Rick A. Britton, Lenexa, KS (US)

( * ) Notice: Subject to any disclaimer, the term of this patent is extended or adjusted under 35 U.S.C. 154(b) by 208 days.

(21) Appl. No.: 11/901,951

(22) Filed: Sep. 19, 2007

Related U.S. Application Data

(60) Provisional application No. 60/847,982, filed on Sep. 28, 2006, provisional application No. 60/845,704, filed on Sep. 19, 2006.

(51) Int. Cl.
*G08B 23/00* (2006.01)

(52) U.S. Cl. ..... 340/502; 340/506; 340/541; 379/45

(58) Field of Classification Search ..... 340/502, 340/501, 506, 539.1, 540, 541, 286.01, 286.05, 340/825.49; 379/37, 38, 45; 455/404.1
See application file for complete search history.

(56) References Cited

U.S. PATENT DOCUMENTS 6,667,688 B1 * 12/2003 Menard et al. ..... 340/531
6,759,956 B2 * 7/2004 Menard et al. ..... 340/539.19
6,781,509 B1 * 8/2004 Oppedahl et al. ..... 340/286.01
6,847,293 B2 * 1/2005 Menard et al. ..... 340/539.1
6,943,682 B1 * 9/2005 Dowens et al. ..... 340/506
7,528,711 B2 * 5/2009 Kates ..... 340/506

* cited by examiner

*Primary Examiner*—Davetta W Goins
(74) *Attorney, Agent, or Firm*—Jonathan A. Bay

(57) ABSTRACT

Apparatus for alarm data communication with a central alarm-monitoring station having a central station receiver linked to a communications medium involves a remote, premise-protecting alarm system. It has a central processing unit (CPU), at least one sensor reporting to the CPU, an interface for communications with the central station receiver across the communications medium, and at least one user interface for a user to enter inputs to the CPU. The alarm system furthermore has a pro-active verify utility configured to allow a user, after the alarm system has automatically propagated a message to the central station receiver comprising a report of an exception sensed by the sensor, to enter an input through the user interface that causes the alarm system to propagate a later message comprising the user's verification. Preferably the user interface is a keypad, and the pro-active verify utility is actuated by minimal key strokes.

8 Claims, 3 Drawing Sheets

METHOD FOR THE PROACTIVE VERIFICATION OF ALARM SIGNALS FROM THE PROTECTED PREMISE LOCATION

CROSS-REFERENCE TO PROVISIONAL APPLICATION(S)

This application claims the benefit of U.S. Provisional Application No. 60/845,704, filed Sep. 19, 2006; and U.S. Provisional Application No. 60/847,982, filed Sep. 28, 2006; the disclosures of both of which are incorporated herein by this reference.

BACKGROUND OF THE INVENTION

1. Field of the Invention

This invention relates to a user's interaction with an electronic security system and, more particularly, to a provision which provides the user the ability to signal a central alarm-monitoring station the validity of a protected-premise alarm signal. It is an aspect of the invention that it speeds-up the response time of the authorities as dispatched by the central alarm-monitoring station.

A number of additional features and objects will be apparent in connection with the following discussion of the preferred embodiments and examples with reference to the drawings.

2. Prior Art

When a premise-protecting alarm system trips, it not only begins to ring bells or sirens on the protected premise but also immediately transmits an alarm signal to a central alarm-monitoring station. Briefly, a premise-protecting alarm system comprises a central processing unit (CPU), a network of sensors reporting to the CPU, one or more communications link(s) to the central alarm-monitoring station, and one or more user-interface devices for entering inputs including not only perhaps high-level programming but basic commands such as and without limitation Arming, Disarming, Extending Schedules, Deleting User Codes and so on. A fairly standard user-interface device is a keypad. It typically comprises a cabinet (typically for mounting on a wall), a display, and an array of pushbuttons or keys (for comparison, see, eg., FIG. 1).

As a matter of terminology, the 'initiating' cause which causes any of the numerous sensors to (in turn) cause the alarm system to trip is referred to as an "exception." Not all exceptions are alarm events. Some are accidental trips. To silence the bells or sirens, an authorized user might enter his or her authorizing code (eg., password) and thereby disarm the alarm system. However, the CPU is typically be configured to respond to the alarm system being disarmed within a short grace period by following its earlier-sent alarm signal with a "Cancel Report" signal to the central alarm-monitoring station. This following signal, comprising a cancel instruction, in turn cancels any activity by the central alarm-monitoring station to dispatch the authorities. Again, the CPU sends the cancel instruction automatically, and this might be contrary to the wishes of the authorized user. That is, all that the authorized user may have wanted to do was silence the bells and sirens, then investigate the validity of the initiating cause, concurrently while expecting the authorities to arrive at any second. However, by silencing the bells and sirens, the authorized user had inadvertently canceled the dispatch.

It is typical for alarm systems to be configured such that, when an exception occurs (and an alarm goes off), an alarm signal is transmitted to the central alarm-monitoring station without regard to the accuracy or appropriateness of the alarm signal itself. However, it is an aspect of the prior art that, to date, there is no way for anyone on site—regardless if an authorized user or anyone else—to actually signal the central alarm-monitoring station through the alarm system's communication link(s) a confirmation signal (or alternatively a verify or authentication signal) of the alarm in a pro-active manner. That is, if an alarm goes off—and someone on site has knowledge or belief that the authorities need to be dispatched right away—then that person has no means through use of the keypad to signal the central alarm-monitoring station such a verify or authentication signal.

The current prior-art practice only allows for authorized users or other persons on premise to await contact from the central alarm-monitoring station, usually by a phone call to the premise (or else to someone who is designated as a "Key Holder" or person responsible for the premise).

At the point of contact, the central station's operator will ask the person, who may or may not be aware of any such initial alarm, if there is an exception or difficulty or other issue that should cause the alarm to transmit. If the contacted-person does not confirm the validity of the original alarm, or if the contacted-person does not happen to have specific knowledge of the initiating alarm, the central station will most likely abort or not dispatch the alarm to the proper authorities (sometimes based on a prearranged policy or wishes of the premise owners) . . . calling the incident a "False Alarm".

In some cases certain central stations have started to enact what is called "two-call verification." In two-call verification, the process is simply repeated twice completely from the beginning, to verify the initiating alarm signal is valid. All of this process can take from 3-15 minutes or longer. Thus this process delays the most critical types of alarm signals, the ones that occur when a valid user is on the premise and has the ability to verify immediately the validity of the alarm AND authenticate themselves as an authorized user by entry of an authorized code.

What is needed is an improvement to overcome the shortcomings of the prior art.

SUMMARY OF THE INVENTION

The following comprises a list of terms or elements and brief definitions therefor.

Keypad: The portion of an Electronic Security system that allows a person, typically the administrator or owner of the property to manage the alarm system, doing functions like arming, disarming and interacting with the system through the menu buttons and (eg., LCD) display.

User: The owner or administrator or person who is operating the alarm system.

Verify: To double check or validate that a report is authentic. Verification of alarms is generally accomplished by calling the premise and talking with the user or whoever answers the phone to check and see if this person concurs with the report that the security system is reporting.

Premise: The location, building, or home that an alarm system is installed to protect (this includes ATM machines, a vault, and so on).

Alarm System: An electronic system comprised of a network of sensors that report back to a central processing unit (CPU). The CPU includes a method of communication to a central station receiver. The CPU will communicate when one or more of the logical rules of the CPU or one or more of the sensors are violated in a manner in which the system is preprogrammed to transmit this exception to the central station receiver. Usually the transmission of said exception state (or alarm) means that an unauthorized person or persons are trying to attack the premise in such a way as to cause damage or steal items within the premise or cause harm to the occupants of the premise.

Central Station Receiver: The piece of electronic equipment that the Alarm system CPU communicates to at a distant location. The central (alarm-monitoring) station is a command center in which these alarm signals are processed.

Central Station Operator's Screen: Central Stations process alarm signals by displaying them in order of priority via a parsing and routing software application. The software application will display the alarms on an operator's terminal screen, to which the operator will apply policies, accepted best practices and common sense to validate or verify the alarm signal and then communicate that message to the proper authorities or responsible party for resolution.

Given the foregoing, the following comprises a brief summary of the invention.

It is an object of the invention to provide a button on a keypad that allows the user of an electronic alarm system to verify an alarm.

It is another object of the invention to place such a button on the keypad with an appropriate label such as "verify" to allow the user of the alarm system to "verify" or authenticate that there is in fact a valid alarm at the premise location. By pressing the "verify" button to verify the alarm, the alarm system will then transmit a unique message to the central station receiver, which will eventually display on the central station operator's screen. This information will be used by the operator to immediately dispatch the authorities (which can be either police and like public-safety enforcement entities, or other parties responsible for resolution), without having to take the time to manually verify the alarm.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIGS. 2 through 4 comprise a sequence of block diagrams that tile together and collectively show apparatus and processes in accordance with the invention for carrying out the method in accordance with the invention for proactive verification of alarm signals from the protected premise location, wherein:

FIG. 2 is an initial block diagram of the sequence,

FIG. 3 is an intermediate block diagram of the sequence, and

FIG. 4 is a terminal block diagram of the sequence.

DETAILED DESCRIPTION OF THE PREFERRED EMBODIMENTS

Figure 1:
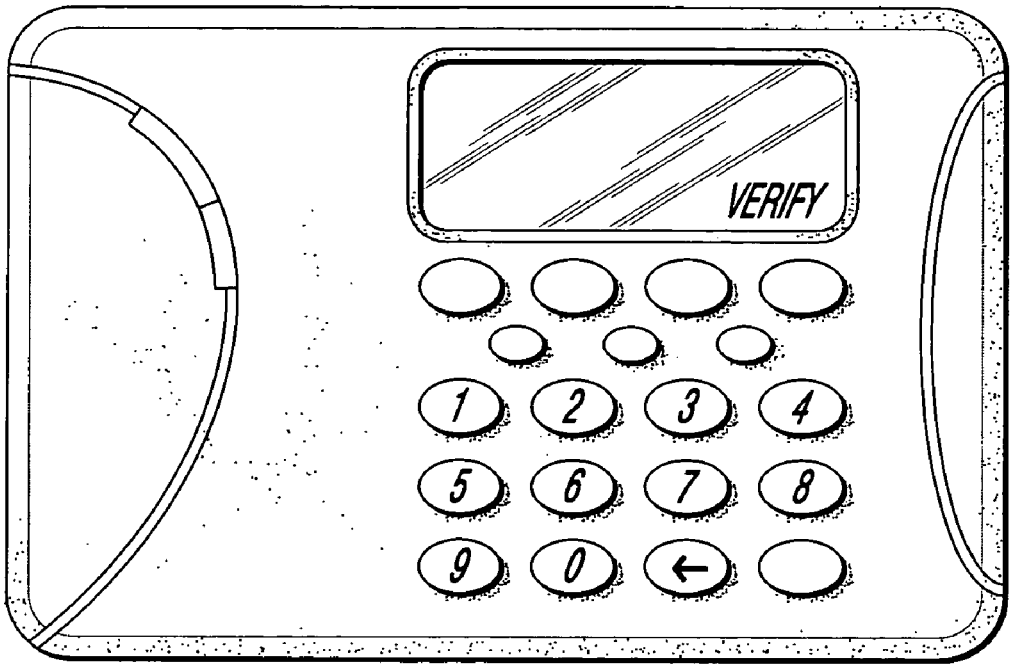
FIG. 1 is a front elevational view of a keypad in accordance with the invention for a premise-protecting alarm system.

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains.

FIG. 1 shows a keypad in accordance with the invention for a premise-protecting alarm system. This keypad comprises a conventional cabinet (typically for mounting on a wall), a display, and an array of pushbuttons or keys. Nowadays, displays are typically LCD screens. As for the keys, they can be actual pushbuttons, or else capacitor-based switches, or alternatively outlined frames on an interactive display, and so on.

It is an aspect of the invention that this keypad includes a special-function key for the purpose of implementing the proactive "Verify" feature in accordance with the invention. That is, a selected key of the keypad is designated for the special purpose of the proactive "Verify" feature in accordance with the invention. This special purpose key might be added to a conventional keypad, or an existing key might be permanently re-assigned to the special purpose function, or an existing key might be automatically re-assigned the special purpose function only temporarily so long as special conditions are met, and so on.

The inventive incorporation a special purpose "Verify" key is added to the keypad of the alarm system itself, coupled with the transmission of an alarm verification message to the central station receiver with the intent of it ending up on the Central Station Operators screen, and thereby allowing the central station operator to take immediate and decisive action.

Figure 2:
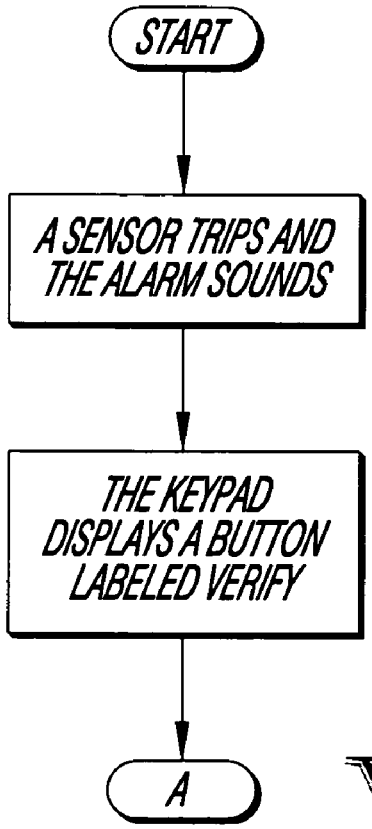
Figure 3:
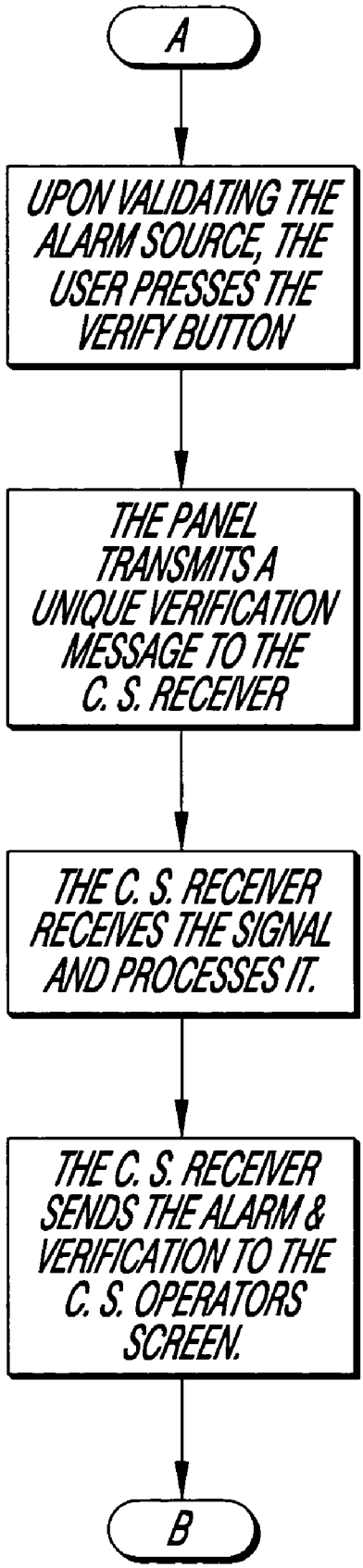
Figure 4:
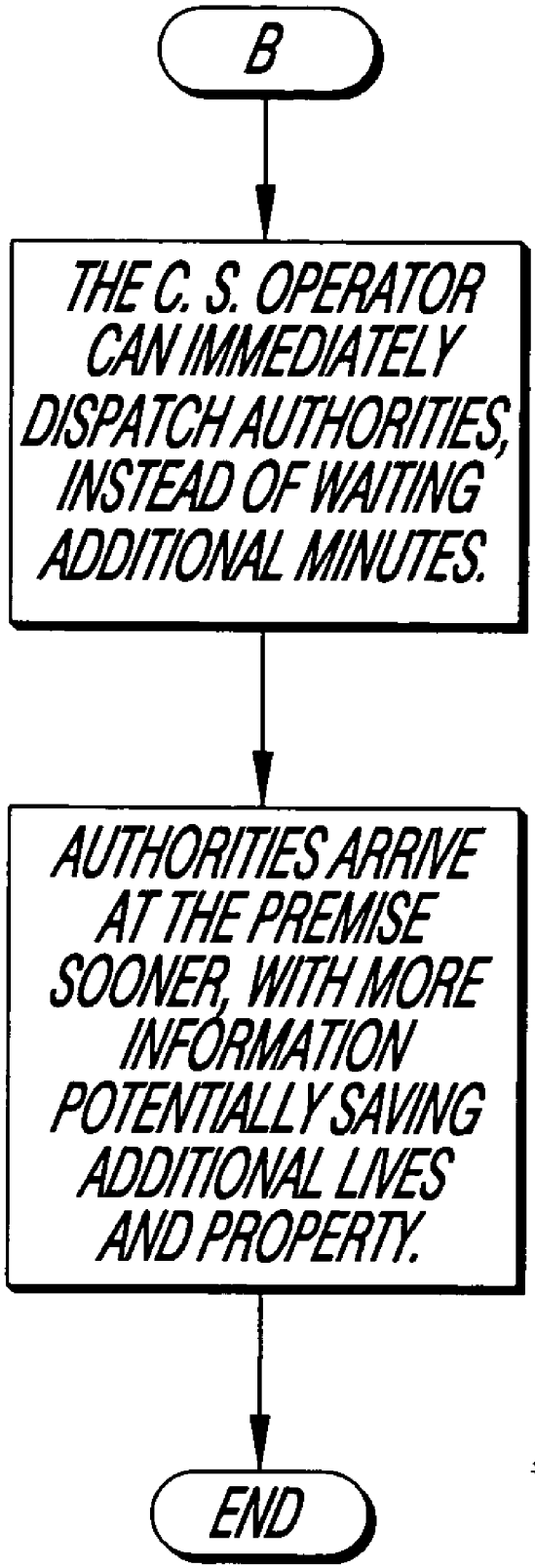

FIGS. 2 through 4 comprise a sequence of block diagrams that tile together and collectively show apparatus and processes in accordance with the invention for carrying out the method in accordance with the invention for proactive verification of alarm signals from the protected premise location. In some respects, FIGS. 2 through 4 comprise a flowchart as well.

The advantages over the prior art are many and varied, but chiefly among them are that this invention allows the end user, the person who is potentially in danger, or at very least the person who has the most amount of information about the source of the alarm signal, to immediately verify the alarm signal in a proactive manner.

All other systems or methods require the Central Station to take many additional minutes and many additional steps (any one of which could be flawed) to verify the origin of the alarm signal.

This invention allows the user, either anyone or one who is specifically authorized (as more particularly described below), who is onsite, and who is knowledgeable about the initiation of the alarm to immediately verify the alarm and set in motion a sequence of events which lead the central station to immediately initiate dispatch.

It is an aspect of the invention to provide at least two options concerning who is allowed to launch (eg., propagate across a communications medium) the "Verify" message. One option is to allow anybody to launch the "Verify" message, another option (without limitation of there being further options) is to launch the launch of the "Verify" message to specifically authorized parties only. By way of background, the population of people at the premise location at the time the "Verify" message is useful may be divided into three sets of people (if any, maybe no one is there, or persons in less than the three sets are there).

The first set comprises administrator(s) or owner(s) of the premise who manage the alarm system, doing functions like arming, disarming and interacting with the system through the menu buttons and display or the keypad, typically after entry of password or other satisfaction of authorized status (eg., an RFID transponder and so on).

The second set comprises friendly bystanders (eg., non-administrator employees or else family member and house guests). The third set comprises intruders, or otherwise clearly unauthorized parties.

In view of the foregoing, one option is to allow anybody to launch the "Verify" message. To implement this, the "Verify" feature of the keypad is prominently displayed, and activating the launch of the "Verify" message is freely available to everyone, it not being launched by a password or special knowledge of the activation. The rationale behind this is that, it does not matter who is onsite, and who is knowledgeable about the initiation of the alarm and is capable of immediately verifying the alarm. It is by design preference to allow friendly bystanders to launch the "Verify" message, even if they have no other permissions to enter any other inputs through the keypad. Although it would be unforeseeable that an intruder would launch the "Verify" message, there is no reason to lock them out from doing so. If the intruder would do so in ignorance, so much for the better.

The other option is to launch the launch of the "Verify" message to specifically authorized parties only. They would be launched by special knowledge of the activation of the "Verify" feature. For example, specifically authorized parties might pre-program the keypad to accept the entry of key number "5" as switch for the launch "Verify" message. The CPU could be configured such that, after an alarm is tripped, the single entry of "5" stands for 'launch the "Verify" message.' Only parties possessing that knowledge would be able to do so (without a lucky guess). That way, the "Verify" message could be launched by a single key, without necessity of entering a password. Entry of any other key would disable the "Verify" feature for the time being (but perhaps allowing entry of a password for access to other functions of the alarm system). Therefore, the key which activates the "Verify" is not prominently displayed at all times. It takes special knowledge to know which key is the operative key.

This option would not allow the friendly bystanders to launch the "Verify" message, presumptively because they are likely to be confused about when to do so is appropriate or not. The decision when to do so is launched to the specifically authorized parties.

Another way to implement the same launched-availability of the "Verify" feature is to combine a prominently-displayed "Verify" key with an RFID proximity-reader wherein the "Verify" feature is only enable if an identified RFID party is within proximity. The assumption is that, the party activating the "Verify" key is presumptively one specifically authorized to do so.

This application is commonly-invented in-part with U.S. Pat. No. 7,239,236 (B1)—Britton, entitled "Wireless sensors for alarm system operations;" U.S. Pat. No. 6,650,238 (B1)—Britton, entitled "Communication path integrity supervision in a network system for automatic alarm data communication;" and, U.S. Pat. No. 6,592,043 (B1)—Britton, entitled "Fixture to mount a miniature proximity transponder to another article," the full disclosures of each of which are incorporated by this reference thereto.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method of alarm data communication, comprising the steps of:

protecting a premise with a premise-sited automatic alarm controller, providing a remote central station with receiving equipment for receiving data communications from a plurality of alarm data communicators including said premise-sited automatic alarm controller, providing the premise-sited automatic alarm controller with a network of premise-sited alarm sensors which report premise-related exceptions not to the central station but to said premise-sited automatic alarm controller, providing one or more communications links between the premise-sited alarm controller and the remote central station's receiving equipment, when an exception occurs with any sensor, said sensor reporting the exception to the automatic alarm controller, in response, the automatic alarm controller sending an exception message to the remote central station's receiving equipment, in case of a user on the premise, then providing the user a way to verify the exception with the remote central station, comprising:

providing the premise-sited automatic alarm controller with a user interface for entry of a verify option, the user interacting with user interface to enter the verify option, in response, the automatic alarm controller automatically sending a verify signal to the remote central station's receiving equipment, whereby the user initiates the verify signal at the premise-sited automatic alarm controller's user interface, which verify signal then travels from the premise-sited automatic alarm controller and into the central station via the receiving equipment thereof.

2. The method of alarm data communication of claim 1, further comprising:

providing the remote central station with prioritizing software for prioritizing the messages and/or signals received by the receiving equipment from the plurality of alarm data communicators which include said premise-sited automatic alarm controller; and wherein the step of, in response, the automatic alarm controller automatically sending a verify signal to the remote central station's receiving equipment, further comprises:

in response, the automatic alarm controller automatically sending a verify signal to the remote central station's receiving equipment to be prioritized the prioritizing software, whereby the user initiates the verify signal at the premise-sited automatic alarm controller's user interface, which verify signal then travels from the premise-sited automatic alarm controller and into the central station's prioritizing software.

3. The method of alarm data communication of claim 2, further comprising:

providing the remote central station with human operators and operator interfaces for the prioritizing software to serve the prioritized messages; and wherein the step of, in response, the automatic alarm controller automatically sending a verify signal to the remote central station's receiving equipment to be prioritized the prioritizing software, further comprises:

in response, the automatic alarm controller automatically sending a verify signal to the remote central station's receiving equipment, to be prioritized the prioritizing software, and thus served to the operator interface of at least one human operator, whereby the user initiates the verify signal at the premise-sited automatic alarm controller's user interface, which verify signal then travels from the premise-sited automatic alarm controller and into at least one human operator's operator interface at the central station's prioritizing software.

4. The method of alarm data communication of claim 3, wherein:

said operator interfaces comprises displays representational of at least aspects of the prioritized messages and/or signals, whereby the operator is adapted to—in response to the displays—apply policies, accepted best practices and/or common sense to validate whether to contact an authority or other responsible party for resolution.

5. The method of alarm data communication of claim 1, further comprising:

providing the premise-sited automatic alarm controller with a proximity-reader for RFID (radio frequency identification device) transponders; and providing the user with an authorized RFID transponder such that, within proximity of the proximity-reader, the premise-sited automatic alarm controller will automatically enable the user interface 'verify' option for said user.

6. The method of alarm data communication of claim 5, further comprising:

providing the premise-sited alarm message controller with a local display such that, upon enablement of the 'verify' option, the 'verify' option will be indicated by the local display.

7. The method of alarm data communication of claim 6, wherein:

the 'verify' option comprises a keypad entry which is neither enabled nor indicated until the user's authorized RFID transponder is within proximity of the premise-sited automatic alarm controller's proximity-reader.

8. The method of alarm data communication of claim 6, wherein:

the 'verify' key comprises a single manual keypad entry which is neither enabled nor indicated until the user's authorized RFID transponder is within proximity of the premise-sited automatic alarm controller's proximity-reader.

* * * * *